US009401269B2

(12) United States Patent
Shirakawa

(10) Patent No.: US 9,401,269 B2
(45) Date of Patent: Jul. 26, 2016

(54) SOCKET AND DISCHARGE LAMP

(71) Applicant: Toshiba Lighting & Technology Corporation, Yokosuka-shi, Kanagawa-ken (JP)

(72) Inventor: Osamu Shirakawa, Yokosuka (JP)

(73) Assignee: Toshiba Lighting & Technology Corporation, Yokosuka-shi, Kanagawa-ken (JP)

( * ) Notice: Subject to any disclaimer, the term of this patent is extended or adjusted under 35 U.S.C. 154(b) by 0 days.

(21) Appl. No.: 14/609,568

(22) Filed: Jan. 30, 2015

(65) Prior Publication Data

US 2015/0380234 A1 Dec. 31, 2015

(30) Foreign Application Priority Data

Jun. 30, 2014 (JP) ..... 2014-134746

(51) Int. Cl.

| | |
|---|---|
| ***H01J 31/04*** | (2006.01) |
| ***H01J 61/36*** | (2006.01) |
| ***H01J 61/16*** | (2006.01) |
| ***H01R 13/405*** | (2006.01) |
| ***H01J 61/04*** | (2006.01) |
| ***H01J 5/54*** | (2006.01) |
| ***H01J 5/62*** | (2006.01) |
| ***H01J 9/36*** | (2006.01) |
| *H01K 1/46* | (2006.01) |

(52) U.S. Cl.

CPC . *H01J 61/04* (2013.01); *H01J 5/54* (2013.01); *H01J 5/62* (2013.01); *H01J 9/36* (2013.01); *H01J 61/16* (2013.01); *H01J 61/368* (2013.01); *H01R 13/405* (2013.01); *H01K 1/46* (2013.01)

(58) Field of Classification Search

None

See application file for complete search history.

(56) References Cited

U.S. PATENT DOCUMENTS

| | | | | |
|---|---|---|---|---|
| 4,156,265 | A * | 5/1979 | Rose | H01R 33/962 200/51 R |
| 5,506,763 | A * | 4/1996 | Carley | F21V 7/0058 313/113 |
| 6,239,539 | B1 | 5/2001 | Mochiduki et al. | |
| 8,278,233 | B2 | 10/2012 | Miyazawa et al. | |
| 2003/0060089 | A1 * | 3/2003 | Fan | F21V 19/0005 439/699.2 |
| 2009/0023341 | A1 * | 1/2009 | Craig | H01R 13/648 439/620.21 |
| 2009/0280679 | A1 * | 11/2009 | Chang | H01R 13/7175 439/490 |

FOREIGN PATENT DOCUMENTS

| | | | |
|---|---|---|---|
| DE | 4001896 | A1 | 10/1990 |
| JP | 2004-103306 | A | 4/2004 |
| WO | 2011/009686 | A2 | 1/2011 |

OTHER PUBLICATIONS

Nov. 24, 2015—(EP) Extended Search Report—App 15152306.5.

* cited by examiner

*Primary Examiner* — Ashok Patel

(74) *Attorney, Agent, or Firm* — Banner & Witcoff, Ltd.

(57) ABSTRACT

A socket includes a main body section, a terminal provided in the main body section and assuming a cylindrical shape, a lead wire being welded to an end face provided at one end portion of the terminal, and an insulating section provided on the inside of the terminal, including a hole section through which the lead wire is inserted, and containing resin. When the cross sectional dimension of the lead wire is represented as W and the opening dimension of the hole section on the end face side is represented as "a", the socket satisfies the following expression:

$$1.5\,W \leq a \leq 2.5\,W.$$

8 Claims, 2 Drawing Sheets

SOCKET AND DISCHARGE LAMP

CROSS-REFERENCE TO RELATED APPLICATIONS

This application is based upon and claims the benefit of priority from Japanese Patent Application No. 2014-134746, filed on Jun. 30, 2014; the entire contents of which are incorporated herein by reference.

FIELD

Embodiments described herein relate to a socket and a discharge lamp.

BACKGROUND

There is a discharge lamp including a light-emitting section including a discharge space on the inside, a pair of electrodes, one ends of which are provided on the inside of the discharge space, a lead wire electrically connected to one electrode, and a socket including a terminal to which the lead wire is welded.

An insulating section made of resin is provided on the inside of the terminal to prevent abnormal discharge between the lead wire and the terminal.

When the lead wire and the terminal are welded, the resin material of the insulating section sublimes and sometimes permeates into a welded section.

When the resin permeates into the welded section, a crack is likely to occur in the welded section because of a difference in a coefficient of thermal expansion.

In this case, if the distance between the welded section and the insulating section is simply increased, workability in inserting the lead wire into a hole section provided in the end face of the terminal is deteriorated.

Therefore, there is a demand for development of a socket and a discharge lamp in which reliability of a welded section and workability in inserting a lead wire can be improved.

DETAILED DESCRIPTION

Figure 1:
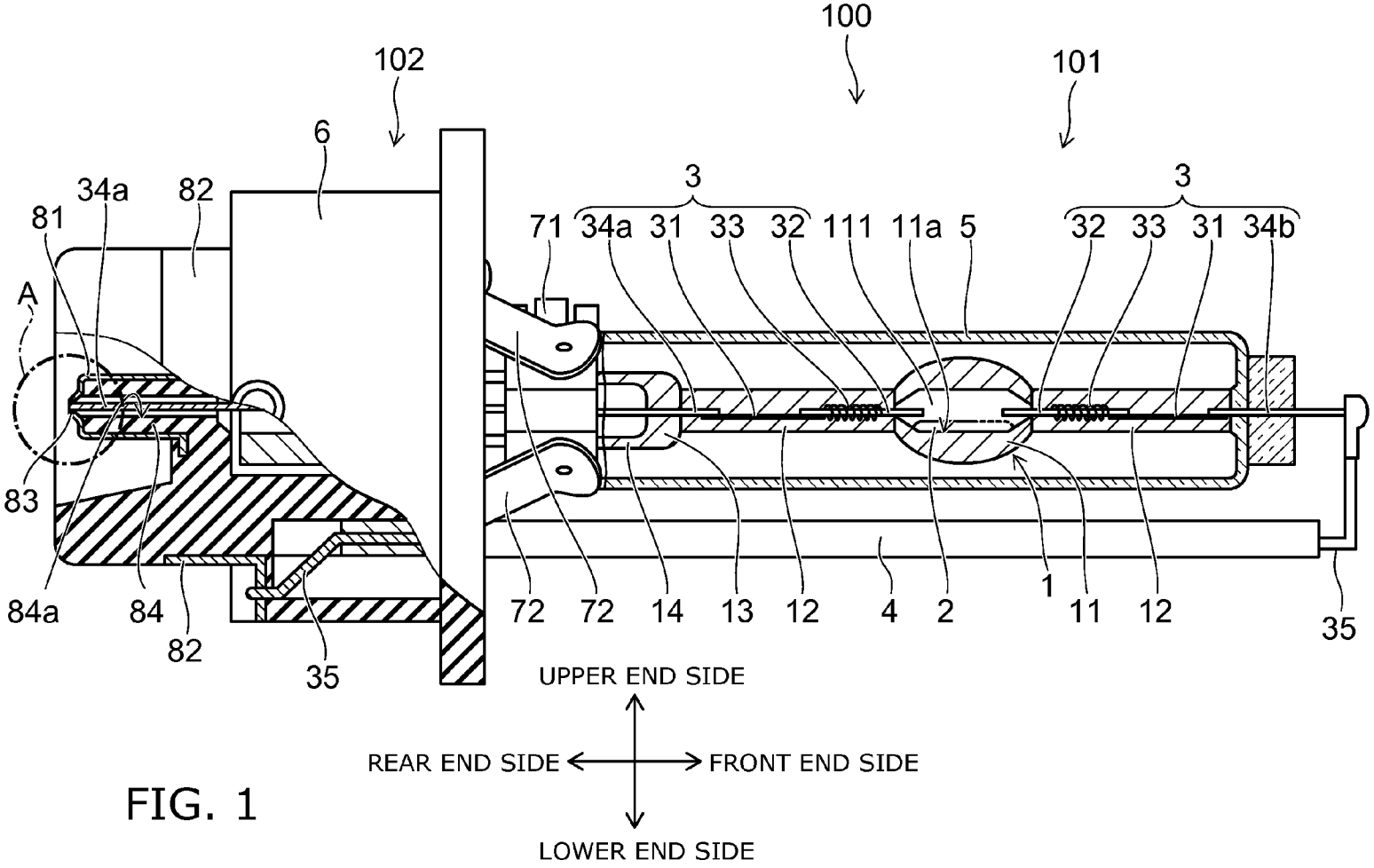
FIG. 1 is a schematic diagram for illustrating a discharge lamp according to an embodiment.

In general, according to one embodiment, there is provided a socket including: a main body section; a terminal provided in the main body section and assuming a cylindrical shape, a lead wire being welded to an end face provided at one end portion of the terminal; and an insulating section provided on the inside of the terminal, including a hole section through which the lead wire is inserted, and containing resin.

When the cross sectional dimension of the lead wire is represented as W and the opening dimension of the hole section on the end face side is represented as "a", the socket satisfies the following expression:

$$1.5\ W \leq a \leq 2.5\ W$$

With this socket, it is possible to improve reliability of a welded section and workability in inserting the lead wire.

The socket can further include an inclined section provided on the end face, the cross sectional dimension of the inclined section gradually decreasing toward the outside of the terminal.

At least a part of the end portion of the insulating section on the end face side can be provided in the inclined section.

With this socket, it is possible to further improve the workability in inserting the lead wire.

The lead wire and the terminal can be welded using a laser welding method.

With this socket, it is possible to improve the reliability of the welded section.

According to another embodiment, there is provided a discharge lamp including: the socket; a light-emitting section including a discharge space on the inside; a sealing section provided at an end portion of the light-emitting section; an electrode, one end of which is provided on the inside of the discharge space and the other end of which is provided on the inside of the sealing section; and a lead wire electrically connected to the electrode.

With the discharge lamp, it is possible to improve the reliability of the welded section and the workability in inserting the lead wire.

An embodiment is illustrated below with reference to the drawings. Note that, in the figures, the same constituent elements are denoted by the same reference numerals and signs and detailed explanation of the constituent elements is omitted as appropriate.

A discharge lamp according to the embodiment can be, for example, an HID (High Intensity Discharge) lamp used in headlights of an automobile. When the discharge lamp is the HID lamp used in the headlights of the automobile, the discharge lamp can be a lamp that performs so-called horizontal lighting.

The use of the discharge lamp according to the embodiment is not limited to the headlights of the automobile. However, an example is explained in which the discharge lamp is the HID lamp used in the headlights of the automobile.

FIG. 1 is a schematic diagram for illustrating a discharge lamp 100 according to this embodiment.

Note that, in FIG. 1, when the discharge lamp 100 is attached to an automobile, a forward direction is represented as a front end side, a direction opposite to the forward direction is represented as a rear end side, an upward direction is represented as an upper end side, and a downward direction is represented as a lower end side.

As shown in FIG. 1, a burner 101 and a socket 102 are provided in the discharge lamp 100.

In the burner 101, an inner pipe 1, an outer pipe 5, a light-emitting section 11, sealing section 12, electrode mounts 3, a support wire 35, a sleeve 4, and a metal band 71 are provided.

The inner pipe 1 assumes a cylindrical shape and is formed of a material having translucency and heat resistance. The inner pipe 1 can be formed of, for example, quartz glass.

The outer pipe 5 is provided on the outer side of the inner pipe 1 concentrically with the inner pipe 1. That is, the outer pipe 5 and the inner pipe 1 form a double pipe structure.

The outer pipe 5 and the inner pipe 1 can be connected by welding the outer pipe 5 to the vicinity of a cylindrical section 14 of the inner pipe 1. Gas is encapsulated in a closed space formed between the inner pipe 1 and the outer pipe 5. The encapsulated gas can be a dielectric barrier dischargeable gas, for example, one kind of gas selected from neon, argon, xenon, and nitrogen or a mixed gas of these kinds of gas. The sealing pressure of the gas can be set to, for example, 0.3 atm or lower at the normal temperature (25° C.) and is more preferably set to 0.1 atm or lower.

The outer pipe 5 is preferably formed of a material having a coefficient of thermal expansion close to the coefficient of thermal expansion of the material of the inner pipe 1 and having an ultraviolet ray blocking property. The outer pipe 5 can be formed of, for example, quartz glass added with oxide of titanium, cerium, aluminum, or the like.

The light-emitting section 11 assumes a substantially elliptical shape in a cross sectional shape and is provided near the center of the inner pipe 1. On the inside of the light-emitting section 11, a discharge space 111, the center portion of which is a substantially columnar shape and both the ends of which are tapered.

A discharge medium is encapsulated in the discharge space 111. The discharge medium contains metal halide 2 and an inert gas.

The metal halide 2 can be, for example, halide of indium, halide of sodium, halide of scandium, or halide of zinc. As halogen, for example, iodine can be illustrated. However, bromine and chloride can also be used instead of iodine.

Note that the composition of the metal halide 2 is not limited to the illustrated composition and can be changed as appropriate.

The inert gas encapsulated in the discharge space 111 can be, for example, xenon. The encapsulation pressure of the inert gas can adjusted according to a purpose. For example, in order to increase a total luminous flux, it is preferable to set the encapsulation pressure to 10 atm or higher and 20 atm or lower at the normal temperature (25° C.). Besides xenon, neon, argon, krypton, and the like can also be used or a mixed gas of these kinds of gas can also be used.

The sealing section 12 assume a tabular shape and are respectively provided at both the end portions of the light-emitting section 11 in a direction in which a pair of electrodes 32 extends.

The sealing section 12 can be formed using, for example, a pinch seal method. Note that the sealing sections 12 may be formed by a shrink seal method and assume a columnar shape.

At the end portion of one sealing section 12 on the opposite side of the light-emitting section 11 side, a cylindrical section 14 is continuously formed via a boundary section 13.

The electrode mounts 3 are provided on the inside of the sealing sections 12.

In the electrode mounts 3, metal foils 31, the electrodes 32, coils 33, a lead wire 34*a*, and a lead wire 34*b* are provided.

The metal foils 31 assume a thin plate shape and can be formed of, for example, molybdenum, rhenium molybdenum, tungsten, and rhenium tungsten.

The metal foils 31 may have a single layer structure or may have a double layer structure.

The electrodes 32 assume a liner shape having a circular cross section and are formed of, for example, so-called thoriated tungsten obtained by doping thorium oxide in tungsten. Note that the material of the electrodes 32 may be pure tungsten, doped tungsten, rhenium tungsten, or the like.

One ends of the electrodes 32 are welded to the vicinities of the end portions of the metal foils 31 on the light-emitting section 11 sides. The electrodes 32 and the metal foils 31 can be welded by laser welding.

The other ends of the electrodes 32 project into the discharge space 111. The pair of electrodes 32 is arranged such that the distal ends thereof are opposed to each other while keeping a predetermined distance.

The distance between the distal ends of the electrodes 32 can be set to, for example, 3.4 mm or larger and 4.4 mm or smaller.

The diameter dimension of the electrodes 32 can be set to 0.2 mm or larger and 0.4 mm smaller.

When the diameter dimension of the electrodes 32 is smaller than 0.2 mm, since the temperature of the electrodes 32 is too high during lighting, it is likely that scattering (sputtering) of the electrode material into the discharge space 111 increases. When the scattering of the electrode material into the discharge space 111 increases, a luminous flux maintenance factor during lighting decreases and the life of the discharge lamp 100 decreases.

When the diameter dimension of the electrodes 32 exceeds 0.4 mm, it is likely that distortion in the sealing section 12 increases. When the distortion in the sealing section 12 increases, it is likely that a crack or the like occurs in the sealing section 12 during manufacturing and during lighting of the discharge lamp 100.

Note that the diameter dimension of the electrodes 32 does not have to be fixed in the direction in which the electrodes 32 extend. For example, the diameter dimension of the electrodes 32 may be larger on the distal end portion side than on the proximal end side. The distal end portions of the electrodes 32 may be formed in a spherical shape. As in a direct-current lighting type, the diameter dimension of one electrode and the diameter dimension of the other electrode may be different.

The coils 33 can be formed of, for example, a metal wire made of doped tungsten. The coils 33 are wound around the outer sides of the electrodes 32 provided on the insides of the sealing sections 12. In this case, for example, the wire diameter of the coils 33 can be set to about 30 μm to 100 μm and the coil pitch of the coils 33 can be set to 600% or smaller.

The lead wires 34*a* and 34*b* assume a linear shape circular in a cross section and are formed of molybdenum or the like. One end sides of the lead wires 34*a* and 34*b* are welded to the vicinities of the end portions of the metal foils 31 on the opposite side of the light-emitting section 11 sides. The lead wires 34*a* and 34*b* and the metal foils 31 can be welded by laser welding.

The other end sides of the lead wires 34*a* and 34*b* extend to the outside of the inner pipe 1.

The support wire 35 assumes an L shape and is welded to the end portion of the lead wire 34*b* lead out from the front end side of the discharge lamp 100. The support wire 35 and the lead wire 34*b* can be welded by laser welding. The support wire 35 can be formed of, for example, nickel.

The sleeve 4 covers a portion of the support wire 35 extending in parallel to the inner pipe 1. The sleeve 4 assumes, for example, a cylindrical shape and can be formed of ceramic.

The metal band 71 is fixed to an outer circumferential surface on the rear end side of the outer pipe 5.

In the socket 102, a main body section 6, metal fittings 72, a terminal 81, a side terminal 82, and an insulating section 84 are provided.

The main body section 6 is formed of resin.

On the inside of the main body section 6, the rear end side of the lead wire 34*a*, the rear end side of the support wire 35, and the rear end side of the sleeve 4 are provided.

The metal fittings 72 are provided at the end portion on the front end side of the main body section 6. The metal fittings 72 project from the main body section 6 and retain the metal band 71. Since the metal band 71 is retained by the metal fittings 72, the burner 101 is retained by the socket 102.

The terminal 81 is provided on the rear end side of the main body section 6.

The terminal 81 assumes a cylindrical shape.

One end of the terminal 81 is opened. The other end of the terminal 81 is closed. A hole section 81*b* piercing through the center portion of an end face 81*a* is provided at the other end. The end portion of the lead wire 34*a* is inserted into the hole section 81*b*.

The terminal 81 is formed of metal such as stainless steel. The lead wire 34*a* is welded to the end face 81*a* provided at one end portion of the terminal 81.

A welded section 83 is formed in the vicinity of the hole section 81*b* provided in the end face 81*a*.

The insulating section 84 is provided on the inside of the terminal 81 in order to prevent abnormal discharge between the lead wire 34*a* and the terminal 81. For example, the insulating section 84 can be provided to cover the inner wall of the terminal 81.

The insulating section 84 contains resin.

The insulating section 84 can be formed of, for example, PPS (polyphenylene sulfide).

In this case, the material of the resin contained in the insulating section 84 is not particularly limited. However, it is preferable that the material is resin excellent in heat resistance.

In the insulating section 84, a hole section 84*a*, through which the lead wire 34*a* is inserted, is provided. The hole section 84*a* pierces through a space between the end face on the front end side of the insulating section 84 and the end face on the rear end side of the insulating section 84.

The insulating section 84 can also be formed integrally with the main body section 6.

The insulating section 84, the main body section 6, the terminal 81, and the side terminal 82 can be formed using, for example, an insert molding method.

Note that details concerning the welded section 83 and the insulating section 84 are explained below.

The side terminal 82 is provided on the sidewall on the rear end side of the main body section 6. The side terminal 82 is formed of metal and welded to the support wire 35.

The terminal 81 and the side terminal 82 are connected to a not-shown lighting circuit to locate the terminal 81 on a high voltage side and locate the side terminal 82 on a low voltage side. In the case of the headlights of the automobile, the discharge lamp 100 is attached to set the center axis of the discharge lamp 100 in a substantially horizontal state and locate the support wire 35 generally on the lower end side (in a lower part) of the discharge lamp 100. Lighting the discharge lamp 100 attached in such a direction is referred to as horizontal lighting.

The welded section 83 and the insulating section 84 are further illustrated.

Figure 2:
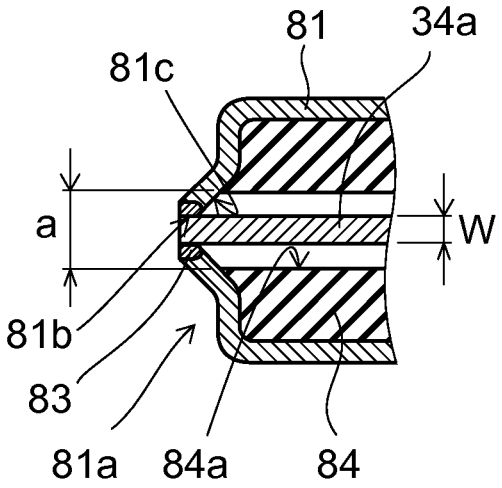
FIG. 2 is a schematic diagram for illustrating a welded section and an insulating section.

FIG. 2 is a schematic diagram for illustrating the welded section 83 and the insulating section 84.

Note that FIG. 2 is a schematic enlarged diagram of an A part in FIG. 1.

In FIG. 2, "a" represents the opening dimension (the cross sectional dimension) on the end surface 81*a* side of the hole section 84*a*. "W" represents the cross sectional dimension of the lead wire 34*a*.

As shown in FIG. 2, the end portion of the lead wire 34*a* is inserted into the hole section 81*b* provided in the end face 81*a* of the terminal 81. The end face 81*a* of the terminal 81 and the end portion of the lead wire 34*a* are welded.

With heat generated when the lead wire 34*a* and the end face 81*a* of the terminal 81 are welded, in some case, a part of the resin contained in the insulating section 84 sublimates and the sublimated resin permeates into the welded section 83.

When the resin permeates into the welded section 83, a crack occurs in the welded section 83 because of a difference in a coefficient of thermal expansion.

In this case, if the opening dimension "a" of the hole 84*a* is increased, the welded section 83 and the insulating section 84 can be separated. Therefore, since it is possible to suppress the influence of the heat in performing the welding, it is possible to suppress the resin from permeating into the welded section 83.

However, the hole section 84*a* functions as a guide when the lead wire 34*a* is inserted into the hole section 81*b* provided in the end face 81*a*.

Therefore, if the opening dimension "a" of the hole section 84*a* is simply increased, workability in inserting the lead wire 34*a* is deteriorated.

The welded section 83 is provided in the vicinity of the hole section 81*b* into which the lead wire 34*a* is inserted. Therefore, the position of the welded section 83 is specified by the cross sectional dimension W of the lead wire 34*a*.

According to the knowledge obtained by the inventor, if the opening dimension "a" of the insulating section 84 and the cross sectional dimension of the lead wire 34*a* are respectively within predetermined ranges, it is possible to improve the reliability of the welded section 83 and the workability in inserting the lead wire 34*a*.

Table 1 is a table for illustrating the influence of the opening dimension "a" of the insulating section 84 and the cross sectional dimension W of the lead wire 34*a* on occurrence of a crack and occurrence of an insertion failure of the lead wire 34*a*.

TABLE 1

| OPENING DIMENSION "a" OF HOLE SECTION | OCCURRENCE OF CRACK | | OCCURRENCE OF INSERTION FAILURE OF LEAD WIRE 34a | |
|---|---|---|---|---|
| 84a | PRESENT | ABSENT | PRESENT | ABSENT |
| 1.3 W | ○ | | | ○ |
| 1.4 W | ○ | | | ○ |
| 1.5 W | | ○ | | ○ |
| 1.6 W | | ○ | | ○ |
| 1.7 W | | ○ | | ○ |
| 1.8 W | | ○ | | ○ |
| 1.9 W | | ○ | | ○ |
| 2.0 W | | ○ | | ○ |
| 2.1 W | | ○ | | ○ |
| 2.2 W | | ○ | | ○ |
| 2.3 W | | ○ | | ○ |
| 2.4 W | | ○ | | ○ |
| 2.5 W | | ○ | | ○ |
| 2.6 W | | ○ | ○ | |
| 2.7 W | | ○ | ○ | |

As it is seen from Table 1, if the opening dimension "a" is set in a range of 1.5 W≤a≤2.5 W, it is possible to suppress occurrence of a crack and occurrence of an insertion failure of the lead wire 34*a*.

In this case, the temperature of the welded section 83 in welding the lead wire 34*a* and the end face 81*a* of the terminal 81 is equal to or higher than temperature at which the resin sublimates. Therefore, the sublimation of the resin could occur irrespective of a type of the resin.

According to the knowledge obtained by the inventor, if the opening dimension "a" is set to 1.5 W or larger, it is possible to suppress occurrence of a crack irrespective of a type of the resin.

As shown in FIG. 2, an inclined section 81*c* connected to the hole section 81*b* can be provided on the end face 81*a*.

The opening dimension (the cross sectional dimension) of the inclined section 81*c* on the opposite side of the hole section 81*b* side is larger than the opening dimension (the cross sectional dimension) of the inclined section 81*c* on the hole section 81*b* side.

In this case, the cross sectional dimension of the inclined section 81*c* gradually decreases toward the outside of the terminal 81.

The opening dimension of the inclined section 81*c* on the hole 81*b* side can be set equal to the cross sectional dimension of the hole section 81*b*.

At least a part of the end portion of the insulating section 84 on the end face 81*a* side is provided on the slope of the inclined section 81*c*.

If such an inclined section 81*c* is provided, the lead wire 34*a* guided by the hole section 84*a* can be guided to the hole section 81*b* by the inclined section 81*c*.

That is, the inclined section 81*c* functions as a guiding section when the lead wire 34*a* is inserted into the hole section 81*b*.

Therefore, it is possible to further improve the workability in inserting the lead wire 34*a*.

A method of welding the lead wire 34*a* and the end face 81*a* of the terminal 81 is not particularly limited.

However, if a welding method for enabling local welding is used, it is possible to suppress a temperature rise of the insulating section 84.

Therefore, it is preferable to weld the lead wire 34*a* and the end face 81*a* of the terminal 81 using the welding method for enabling local welding such as a laser welding method.

Figure 3:
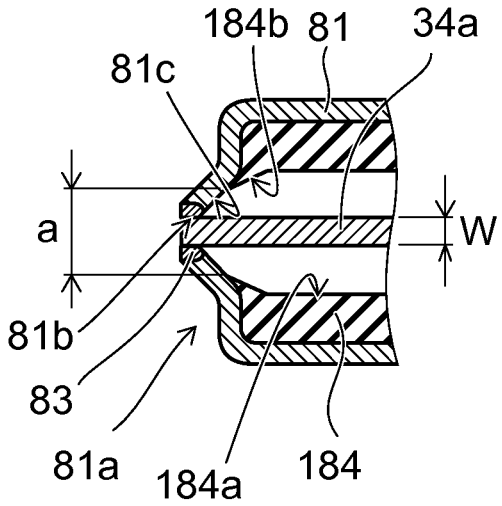
FIG. 3 is a schematic diagram for illustrating the welded section and an insulating section.

FIG. 3 is a schematic diagram for illustrating the welded section 83 and an insulating section 184.

As shown in FIG. 3, the insulating section 184 can be provided instead of the insulating section 84.

In this case, the thickness of the insulating section 184 is smaller than the thickness of the insulating section 84.

If the thickness of the insulating section 184 is reduced, it is possible to suppress a void from occurring when the insulating section 184 is formed using the insert molding method or the like.

However, if the thickness of the insulating section 184 is reduced, the cross sectional dimension of a hole section 184*a* increases. Therefore, it is likely that the function of guiding the lead wire 34*a* is deteriorated.

Therefore, in this embodiment, an inclined section 184*b* connected to the inclined section 81*c* is provided.

The opening dimension (the cross sectional dimension) of the inclined section 184*b* on the opposite side of the hole section 81*b* side is larger than the opening dimension (the cross sectional dimension) of the inclined section 184*b* on the hole section 81*b* side.

In this case, the cross sectional dimension of the inclined section 184*b* gradually decreases toward the outside of the terminal 81.

The opening dimension (the cross sectional dimension) of the inclined section 184*b* on the opposite side of the hole section 81*b* side can be set equal to the cross sectional dimension of the hole section 184*a*.

The opening dimension (the cross sectional dimension) of the inclined section 184*b* on the hole 81*b* side is "a" explained above.

At least a part of the end portion of the insulating section 184 on the end face 81*a* side is provided on the slope of the inclined section 81*c*.

If such an inclined section 184*b* is provided, the lead wire 34*a* guided by the hole section 184*a* can be guided to the hole section 81*b* by the inclined section 184*b* and the inclined section 81*c*.

That is, the inclined section 184*b* functions as a guiding section when the lead wire 34*a* is inserted into the hole section 81*b*.

Therefore, even if the thickness of the insulating section 184 is reduced, the workability in inserting the lead wire 34*a* is not deteriorated.

Further, since it is possible to reduce the thickness of the insulating section 184, it is possible to attain suppression of occurrence of a void, a reduction in weight, a reduction in material costs, and the like.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. Moreover, above-mentioned embodiments can be combined mutually and can be carried out.

What is claimed is:

1. A discharge lamp comprising:

a burner comprising:

a light-emitting section including a discharge space on an inside;

a sealing section provided at an end portion of the light-emitting section;

an electrode, one end of which is provided on an inside of the discharge space and another end of which is provided on an inside of the sealing section; and a lead wire electrically connected to the electrode; and a socket comprising:

a main body section;

a terminal provided in the main body section and having a cylindrical shape, the lead wire being welded to an end face provided at one end portion of the terminal; and an insulating section provided on an inside of the terminal, including a hole section through which the lead wire is inserted, and containing resin, wherein when a cross sectional dimension of the lead wire is represented as "W" and an opening dimension of the hole section on the end face side is represented as "a", the socket satisfies the following expression:

$$1.5\ W \leq a \leq 2.5\ W.$$

2. The discharge lamp according to claim 1, further comprising a first inclined section provided on the end face of the terminal, a cross sectional dimension of the first inclined section gradually decreasing toward an outside of the terminal, wherein at least a part of an end portion of the insulating section on the end face side is provided in the first inclined section.

3. The discharge lamp according to claim 2, wherein the insulating section includes a second inclined section, and the second inclined section is provided on the one end portion of the terminal, and a cross sectional dimension of the second inclined section gradually decreases toward an outside direction of the terminal.

4. The discharge lamp according to claim 3, wherein an opening dimension of the second inclined section on the first inclined section side is equal to an opening dimension of the hole section provided in the insulating section on the end face side.

5. The discharge lamp according to claim 1, wherein one end portion of the lead wire is provided on an inside of a hole provided in the end face of the terminal.

6. The discharge lamp according to claim 1, wherein the terminal contains metal.

7. The discharge lamp according to claim 1, wherein the insulating section contains polyphenylene sulfide.

8. The discharge lamp according to claim 1, wherein the lead wire is of a linear shape and contains molybdenum.

* * * * *